US007320226B2

(12) United States Patent
Strauss

(10) Patent No.: US 7,320,226 B2
(45) Date of Patent: Jan. 22, 2008

(54) FREEZER WITH DEFROST FUNCTION AND METHOD FOR OPERATING THE FREEZER

(75) Inventor: Georg Strauss, Giengen (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 0 days.

(21) Appl. No.: 10/980,968

(22) Filed: Nov. 4, 2004

(65) Prior Publication Data

US 2005/0066667 A1 Mar. 31, 2005

Related U.S. Application Data

(63) Continuation of application No. PCT/EP03/05004, filed on May 13, 2003.

(30) Foreign Application Priority Data

May 16, 2002 (DE) ..... 102 21 904

(51) Int. Cl.
*F25D 21/06* (2006.01)
*F25D 29/00* (2006.01)

(52) U.S. Cl. ..... 62/155; 62/151; 62/162

(58) Field of Classification Search ..... 62/140, 62/151, 153, 154, 155, 156, 162
See application file for complete search history.

(56) References Cited

U.S. PATENT DOCUMENTS

| | | | | |
|---|---|---|---|---|
| 1,979,103 | A | | 10/1934 | Gaynor |
| 2,703,481 | A | | 3/1955 | Charbonneau |
| 3,164,969 | A | | 1/1965 | Baker |
| 4,392,357 | A | * | 7/1983 | Kinsey et al. ..... 62/153 |
| 4,427,952 | A | | 1/1984 | Zumsteg |
| 4,530,218 | A | * | 7/1985 | Janke et al. ..... 62/156 |
| 4,581,901 | A | | 4/1986 | Adams et al. |
| 4,787,063 | A | | 11/1988 | Muguet |
| 5,315,835 | A | * | 5/1994 | Park ..... 62/80 |
| 5,345,775 | A | * | 9/1994 | Ridenour ..... 62/140 |
| 5,369,962 | A | * | 12/1994 | Szynal et al. ..... 62/155 |
| 5,379,608 | A | * | 1/1995 | Ishimaru et al. ..... 62/155 |
| 5,483,804 | A | * | 1/1996 | Ogawa et al. ..... 62/153 |
| 5,806,321 | A | | 9/1998 | Bendtsen et al. |
| 6,138,464 | A | * | 10/2000 | Derosier et al. ..... 62/155 |
| 6,408,634 | B1 | * | 6/2002 | Choi ..... 62/162 |
| 2001/0002540 | A1 | | 6/2001 | Okubo |

FOREIGN PATENT DOCUMENTS

| | | | |
|---|---|---|---|
| EP | 0 676 733 | A1 | 10/1995 |
| EP | 1 180 652 | A1 | 2/2002 |
| GB | 770362 | | 2/1955 |
| JP | 06249566 | A * | 9/1994 |

* cited by examiner

*Primary Examiner*—Chen Wen Jiang
(74) *Attorney, Agent, or Firm*—Russell W. Warnock; James E. Howard

(57) ABSTRACT

A freezer includes a refrigeration surface that can be frozen, such as an evaporator surface, a heating device for heating the refrigeration surface, and a control circuit for controlling the operation of the heating device in accordance with a timer. The control circuit is configured to block the operation of the heating device for a time period that is defined by the timer. The timer is used to ensure that the refrigeration surface is only heated to defrost the freezer, if the refrigeration power requirement of the latter is low.

1 Claim, 5 Drawing Sheets

FREEZER WITH DEFROST FUNCTION AND METHOD FOR OPERATING THE FREEZER

CROSS-REFERENCE TO RELATED APPLICATION

This is a continuing application, under 35 U.S.C. § 120, of copending international application No. PCT/EP03/05004, filed May 13, 2003, which designated the United States; this application also claims the priority, under 35 U.S.C. § 119, of German patent application No. 102 21 904.4, filed May 16, 2002; the prior applications are herewith incorporated by reference in their entirety.

BACKGROUND OF THE INVENTION

FIELD OF THE INVENTION

The present invention relates to a freezer having a cooling surface, on which a layer of ice can form during the course of operation of the freezer, and a heating device for heating up the cooling surface and, thereby, defrosting such a layer of ice.

Such conventional freezers, also referred to as frost-free appliances, have a control device that controls the operation of the heating device and automatically starts the heating device if a run time, detected by a timer, of the appliance or of a compressor of the appliance exceeds a predefined limit value. As such, defrosting of the cooling surface from time to time is also ensured without any active effort on the part of the user. As a result, it is not possible for a layer of ice that is so thick that it significantly impairs the energy efficiency of the appliance to form on the cooling surface.

One problem with this technique is that it is not able to take account of whether or not any items to be frozen have just been put into the freezer shortly before the defrosting process is started. If this is the case, such items to be frozen should be frozen as quickly as possible, for which purpose a high cooling power is required. However, automatic defrosting of the cooling surface precisely at this point in time results in freezing taking a long time and, in unfavorable circumstances, it may even lead to the items to be frozen already stored in the freezer being heated up by the products just put in, such that these stored products begin to thaw.

One further disadvantage of this technique is that it is associated with relatively high energy costs because the increased power requirement of the freezer associated with a defrosting process may occur at any time of the day.

SUMMARY OF THE INVENTION

It is accordingly an object of the invention to provide a freezer with a defrost function and a method for operating the freezer that overcome the hereinafore-mentioned disadvantages of the heretofore-known devices and methods of this general type and that ensures rapid freezing of items to be frozen just put in at any time, and that also make it possible to minimize the energy costs associated with the operation of such an appliance.

With the foregoing and other objects in view, there is provided, in accordance with the invention, a freezer including a cooling surface that can ice up, a heating device being operatively connected to the cooling surface for heating up the cooling surface; and a control circuit being connected to at least one of the heating device and the cooling surface, having a timer for controlling operation of the heating device as a function of the timer, and being configured to prevent operation of the heating device during a time interval defined by the timer.

The freezer does not necessarily have to be a freezer with an automatic defrost facility. According to the invention, the timer is not necessarily used to initiate a defrosting process after a specific time, as is the case in customary frost-free appliances. In contrast, it is used to prevent a defrosting process at specific, unfavorable times. The times at which a defrosting process appears to be necessary can, according to the present invention, be defined both automatically and by a user, as explained in greater detail in the text that follows.

In accordance with another feature of the invention, the time interval defined by the timer is a time-of-day interval, to be precise, preferably, a time-of-day interval that lasts from 9:00 a.m. to 10:00 p.m., preferably, at least from 1:00 a.m. to 5:00 a.m. This definition of the time interval is based on the assumption that there is a low probability of items to be frozen being put into the freezer at night, in particular, between 9:00 a.m. and 10:00 p.m., because most users shop earlier in the day. Extending the time interval in which operation of the heating device is prevented, to from 5:00 a.m. on one day to 1:00 a.m. the next day also has the advantage that low-cost, off-peak electricity can be used for the defrosting process during the period of time still available for defrosting.

In accordance with a further feature of the invention, the cooling surface has an average cooling power outside the time-of-day interval higher than an average cooling power within the time-of-day interval.

In accordance with an added feature of the invention, the freezer according to the invention, preferably, also uses low-cost, off-peak electricity so that—if defrosting does not take place—the cooling surface is operated with a higher cooling power in the period of time permitted for defrosting than during the blocked time interval. Therefore, even during normal operation of the freezer, the energy requirement is shifted from the blocked time interval to the period of time in which defrosting is permitted and in which the costs of electrical energy are lower than in the blocked time interval.

In accordance with an additional feature of the invention, the timer is coupled to a sensor for detecting when a door of the freezer is opened, and the time interval defined by the timer is a time interval starting from when the door is opened. The effect of such a refinement is comparable with that described above. The first effect of in each case preventing defrosting in conjunction with opening of the door for the defined time interval is that items to be frozen just put in can be rapidly frozen during this time interval without the freezing process being interrupted or delayed by defrosting. The probability of the freezer door remaining closed for a long time interval of the order of magnitude of two or more hours is, of course, higher at night than during the day, such that the freezer according to this alternative will, with a correspondingly high probability, also carry out defrosting processes during the night.

In accordance with yet another feature of the invention, the timer for the control circuit may be configured in various ways. Firstly, it may be an autonomous timer that does not receive any control signals from the outside. Such a timer can, in particular, be an oscillator, especially, a crystal oscillator for high accuracy and low costs.

In accordance with yet a further feature of the invention, a radio receiver for receiving a radio time standard may, in particular, be considered as a non-autonomous timer.

In accordance with yet an added feature of the invention, if the freezer is configured for operation in a data network, the interface to such a network can, of course, also be used to receive a time signal transmitted on the network or interrogated therefrom, and to make it available to the control circuit.

In accordance with yet an additional feature of the invention, one preferred application of the invention is in appliances such as the aforementioned frost-free appliances, in which the control circuit is configured to detect at least one operating parameter of the freezer that is correlated with the level of icing up of the cooling surface, and to start the heating device outside the defined time interval if the at least one monitored operating parameter has exceeded a limit value.

Preferred examples of such operating parameters are the total length of time that has elapsed since the last operating phase of the heating device, or the operating time of a compressor of the freezer that has elapsed since the last operating phase of the heating device.

One parameter that, in contrast to the two mentioned above, does not require cumulative detection is the ratio of the operating time to the service life of a compressor of the freezer.

One further suitable parameter is the number of times the door has been opened since the last operating phase of the heating device.

In accordance with again another feature of the invention, the control circuit has an associated control element for entering an instruction to start the heating device. The control element allows the user to enter an instruction to start the heating device at any desired time if the user concludes that defrosting is expedient, in particular, when the user opens the door and, thus, finds that defrosting is necessary. The blocking according to the invention prevents the defrosting process being performed at an unfavorable point in time.

Such a control element may, of course, also be provided as a supplement on a freezer with an automatic defrost facility.

With the objects of the invention in view, there is also provided a freezer, including a cooling surface that can ice up, a heating device being operatively connected to the cooling surface 96) for heating up the cooling surface, and a control circuit being connected to at least one of the heating device and the cooling surface, having a timer for controlling operation of the heating device as a function of the timer, and being programmed to prevent operation of the heating device during a time interval defined by the timer.

A method of controlling a freezer having a cooling surface that can ice up, and a heating device for heating up the cooling surface, includes the steps of defining a blocked time interval in which the cooling surface must not be defrosted, detecting whether or not it is necessary to defrost the cooling surface, and if the time of detection is in a blocked time interval, waiting until the end of the blocked time interval, and, once the blocked time interval has passed, operating the heating device.

In accordance with again a further mode of the invention, the need for defrosting is based upon an entry of an instruction by a user and/or by monitoring at least one operating parameter of the freezer correlated with a level of icing up and detecting the need for defrosting when at least one of operating parameters of the freezer exceeds a limit value.

With the objects of the invention in view, there is also provided a method of controlling a freezer having a cooling surface which can ice up, and a heating device for heating up the cooling surface, including the steps of defining a blocked time interval in which the cooling surface must not be defrosted, detecting if it is necessary to defrost the cooling surface and noting a time of the detection; and one of, if the noted time of the detection is not in the blocked time interval, defrosting the cooling surface, and if the noted time of the detection is in the blocked time interval, waiting until the end of the blocked time interval and operating the heating device once the blocked time interval has passed.

Other features that are considered as characteristic for the invention are set forth in the appended claims.

Although the invention is illustrated and described herein as embodied in a freezer with a defrost function and a method for operating the freezer, it is, nevertheless, not intended to be limited to the details shown because various modifications and structural changes may be made therein without departing from the spirit of the invention and within the scope and range of equivalents of the claims.

The construction and method of operation of the invention, however, together with additional objects and advantages thereof, will be best understood from the following description of specific embodiments when read in connection with the accompanying drawings.

DESCRIPTION OF THE PREFERRED EMBODIMENTS

Figure 1:
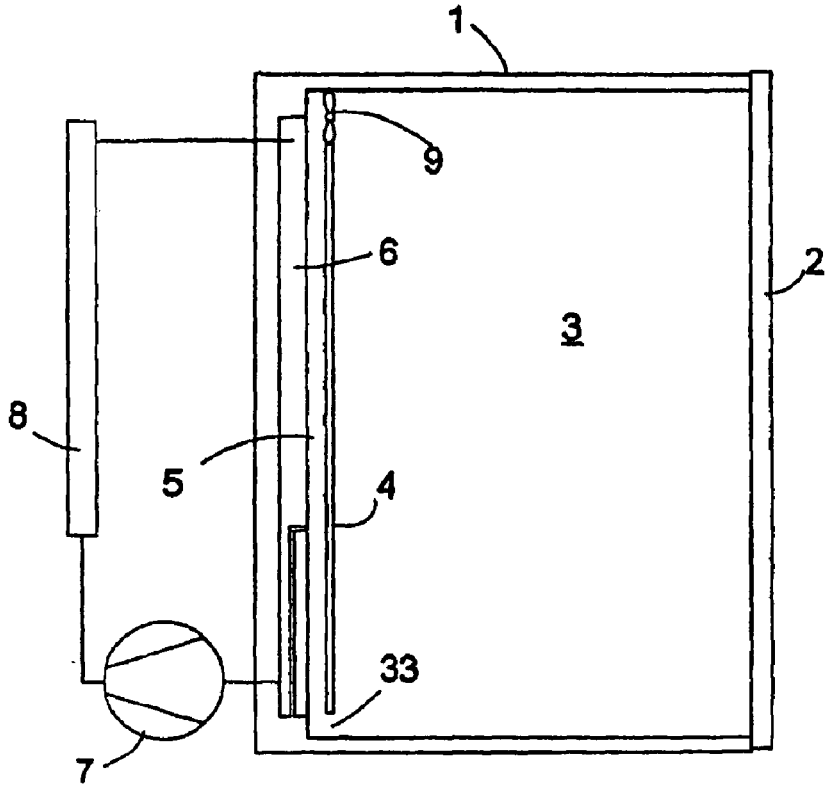
FIG. 1 is a cross-sectional view of a diagrammatic representation of a freezer in which the invention according to the invention can be applied.

The configuration of the freezer shown in FIG. 1 is substantially known and, therefore, is only briefly outlined herein.

Referring now to the figures of the drawings in detail and first, particularly to FIG. 1 thereof, there is shown a thermally insulating housing 1 and a thermally insulating door 2 delimit a freezer compartment 3 in the interior of the housing 1. A wall 4 separates a chamber 5 from the freezer compartment 3. An evaporator 6 serving as a cooling surface is disposed on the rear wall of the chamber 5. The evaporator 6 is part of a refrigerant circuit, together with a compressor 7 and a condenser 8. A fan 9 is disposed in a through-opening in the separating wall 4 to circulate air between the freezer compartment 3 and the chamber 5.

In normal operating conditions, the evaporator 6 is at temperatures below zero degrees Celsius. Moisture from air recirculated from the freezer compartment 3 to the chamber 5 condenses on the surface of the evaporator 6 and forms a layer of ice on the latter after relatively long-term operation. A heating device 10 is disposed in the chamber 5 to be able to defrost this layer of ice.

The invention can, however, also be applied to freezers in which the evaporator 6 is not accommodated in a dedicated chamber but is in direct thermal contact with the freezer compartment 3.

Figure 2:
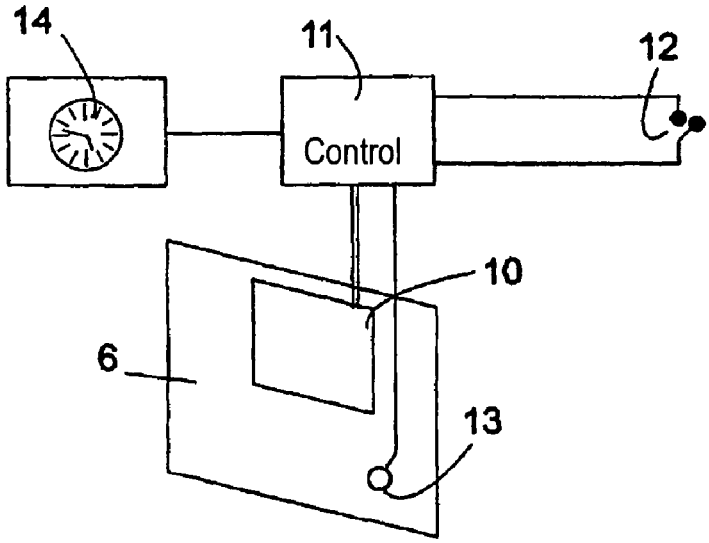
FIG. 2 is a block circuit diagram of a first refinement of a control configuration according to the invention for the freezer.

FIG. 2 shows a first exemplary embodiment of a control configuration for the refrigerator from FIG. 1. The control configuration includes a control circuit 11, for example, a microprocessor or microcontroller, which is connected to a control element 12, for example, an electrical pushbutton fitted to the housing 1, a temperature sensor 13 disposed on the evaporator 6, and a timer 14. The timer 14 is, preferably, in the form of a crystal clock or a radio clock and periodically supplies a quantitative signal that represents the time of day. In the case of an "intelligent" upright freezer, which simultaneously represents a terminal in a data transmission network, the timer 14 may also be the interface to a network because time-of-day signals can be transmitted periodically in such networks or can be requested by another terminal through the interface 14.

Figure 3:
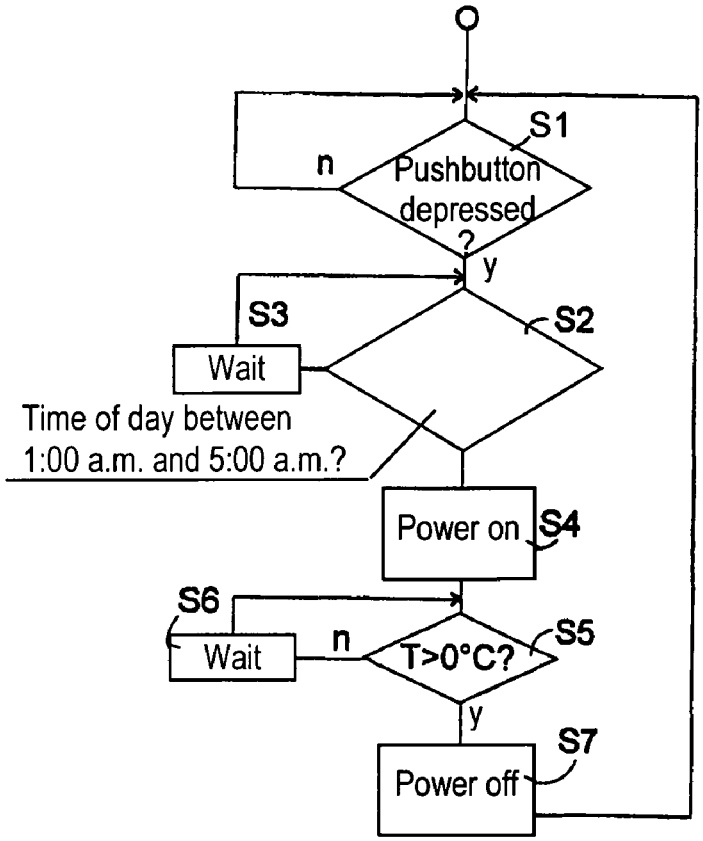
FIG. 3 is a flowchart for a method of operation of the control configuration of FIG. 2.

FIG. 3 shows a first example of a method of operation that can be carried out by the control circuit 11 to defrost the evaporator 6 as required. It is assumed in this method that a defrosting process is not initiated automatically by the control circuit 11, but by an instruction by a user depressing the pushbutton 12. If, in step S1, the control circuit 11 finds that the pushbutton 12 has been depressed, the circuit 11 checks in the next step S2 the time of day supplied by the timer 14. If the time of day is between 5:00 a.m. and 1:00 a.m., the control circuit 11 initially ignores the user instruction and, in step S3, waits until 1.00 a.m. The time interval from 5:00 a.m. to 1:00 a.m. is, therefore, a blocked time interval in which no defrosting process is carried out. The control circuit 11 switches on the power supply to the heating device 10 at 1:00 a.m. and, at the same time, switches off the compressor 7 and the fan 9, if they were on. If the compressor 7 and fan 9 are on, it is possible, as an alternative, for the control circuit 11 to delay initiation of the defrosting process until the operating phases of the compressor and fan end as normal.

If the heating device 10 is run until the sensor 13 detects a final temperature above zero degrees Celsius, this temperature reliably allowing the conclusion that the evaporator 6 is completely defrosted, in step S6, the power supply to the heating device 10 is switched off and normal cooling operation is resumed.

The user can, therefore, enter an defrost instruction by the pushbutton 12 whenever he feels it is appropriate, for example, if the user sees that defrosting is necessary when putting chilled goods in or taking them out. Restricting the defrosting time period to the period of time between 1:00 a.m. and 5:00 a.m. ensures that any items to be frozen just put into the freezer are reliably and thoroughly frozen before the defrosting process is initiated.

It is clear that other limits for the time period in which a defrosting process can be initiated could also be readily defined. It would also be readily possible to specify a fixed time, for example 3:00 a.m., at which a defrosting process can begin in each case.

Figure 4:
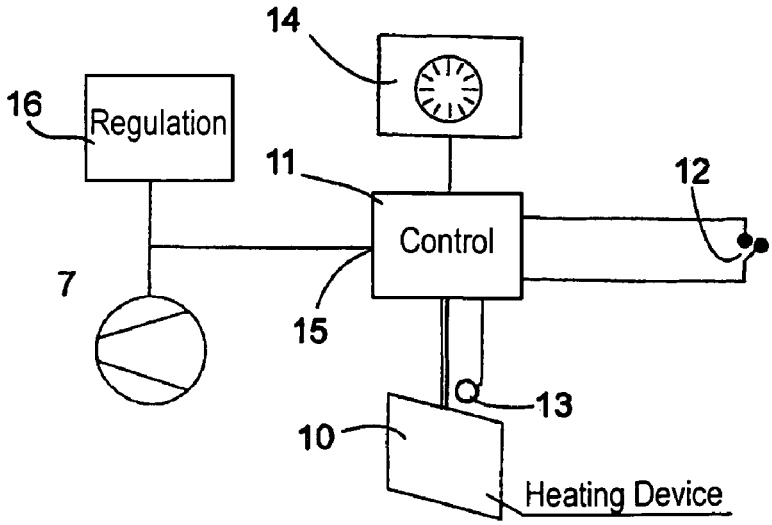
FIG. 4 is a block circuit diagram of a second refinement of the control configuration according to the invention.

FIG. 4 shows one example of a control configuration that permits fully automatic defrosting. The components of this configuration, which have already been described with reference to FIG. 2, have the same reference symbols and are not described separately. The control circuit 11 from FIG. 4 additionally has a signal input 15 to which a control signal for switching the compressor 7 on and off is applied, which control signal is produced by a thermostat regulation circuit 16.

Figure 5:
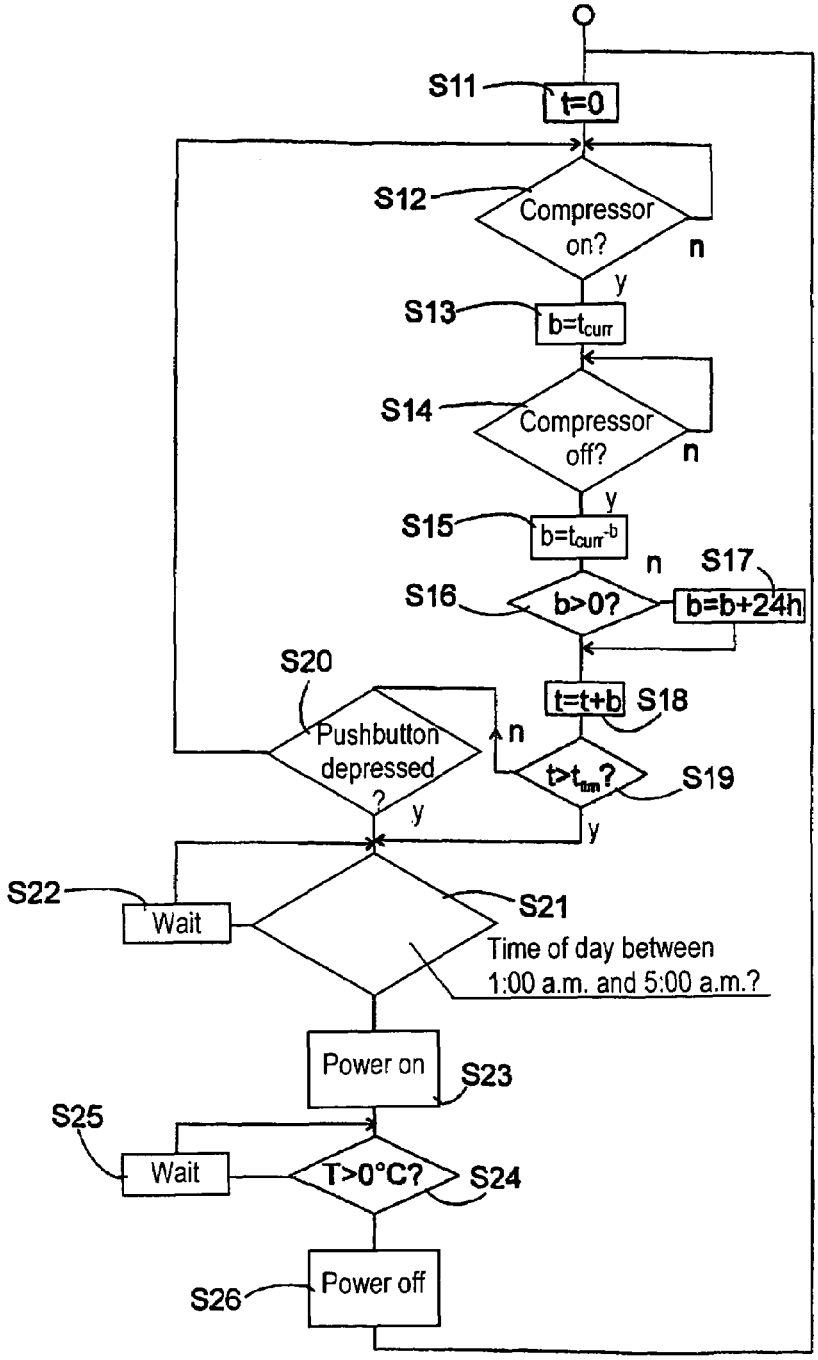
FIG. 5 is a flowchart for method of operation of the control configuration of FIG. 4.

A first example of a method of operation that can be carried out using this refinement of the control configuration is shown in FIG. 5. The method begins by switching on the freezer and, in step S11, setting an operating timer t to zero. As soon as the control circuit 11 detects that the compressor 7 is switched on (S12), it stores the current time of day tcurr in a buffer store b (S13). As soon as it is detected that the compressor has been switched off again, the value in the buffer store b is subtracted from the now current time tcurr and again stored in the buffer store b (S15). If, in step S16, the result is found to be less than zero, the operating phase of the compressor started and ended on different days and 24 hours has to be added to the value in the buffer store b (S17) to obtain the correct duration of the operating phase of the compressor. The duration obtained in this way is added to t (S18) and a check is made (S19) as to whether or not the result is above a maximum permissible compressor total operating time trim between two defrosting processes. If this is the case, defrosting is necessary and the method proceeds to step S21. If this is not the case, a check is made in step S20 as to whether or not the user has depressed the pushbutton 12 and defrosting is necessary for this reason. If this is the case, the method, likewise, proceeds to step S21, and if this is not the case, a new operating phase of the compressor is awaited in step S12.

The contiguous steps S21 and S26 are identical to steps S2 to S7 from FIG. 3 and are not described again here.

In a simplified variant of the control method, the total operating time of the freezer, rather than the compressor running time, since the last defrosting process could readily be measured and the method could jump to step S21 as soon as the total operating time has exceeded a predefined limit value.

Figure 6:
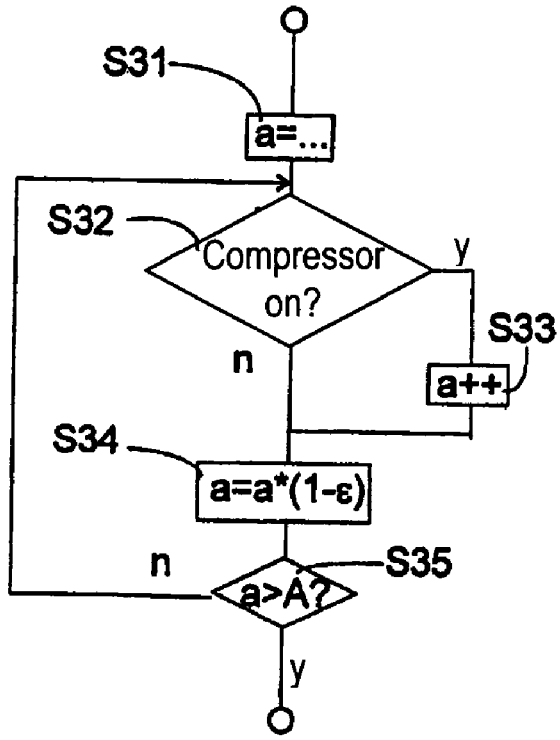
FIG. 6 is a flowchart of a modification to the control method of FIG. 5.

A further refinement of an operating method for the control configuration from FIG. 4 is shown in FIG. 6. In this refinement, the ratio of the running time of the compressor to the running time of the freezer is used as a criterion for determining whether or not defrosting is necessary. This modification has the advantage that it does not use parameters accumulated over the total operating time since the last defrosting process, such that the defrosting process can be correctly initiated even if stored parameter values are lost as a result of a blackout or some other disturbance.

The method begins in step S31 with the initialization of a parameter a, which represents the ratio of the compressor running time to the appliance running time, to a value a that, in principle, can be selected to be any value below a predefined limit value A. In step S32, a check is made as to whether the compressor 7 is on or not. If it is not on, the parameter a is multiplied in step S34 by a "forgetting factor" $1-\epsilon$. If the compressor is on, the parameter is first incremented in step S33. a tends to a value proportional to the desired ratio, by frequent repetition of these steps. In step S35, a check is made as to whether or not the limit value A has been exceeded. If not, steps S32 to S34 are repeated, but if so, defrosting is necessary and steps S21 to S26 follow.

In the control configuration in FIG. 6, the signal input 15 from FIG. 4 is replaced by a connection to a switch 17. This switch 17 is disposed on the housing 1 in a manner known per se to detect when the door 2 is opened and closed, and, accordingly, to switch the interior light of the freezer 3 on and off. In this refinement, the control circuit 11 counts the number of times the door 2 has been opened since the last defrosting process, or alternatively, the total time for which the door 2 has been open since the last defrosting process, and compares the result with a limit value. This method will not be described with reference to a flowchart because its implementation should be understood in general from the examples given above. Steps S21 to S26 are also carried out in this method as soon as the limit value is exceeded.

Figure 7:
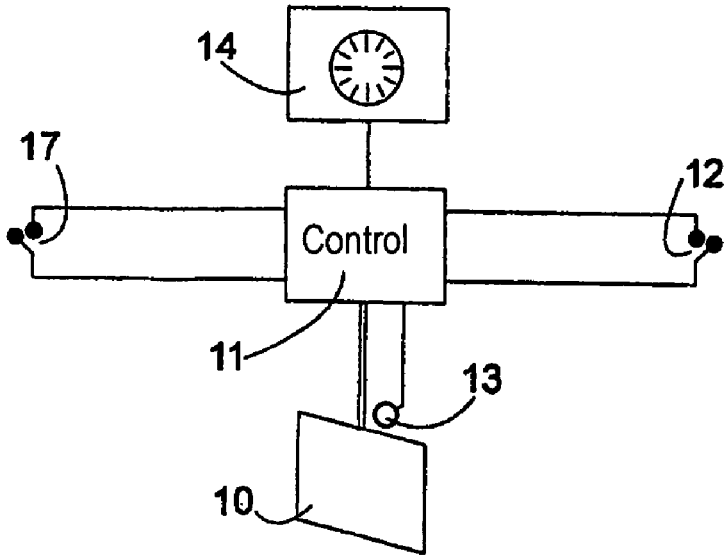
FIG. 7 is a third refinement of a control configuration according to the invention.
Figure 8:
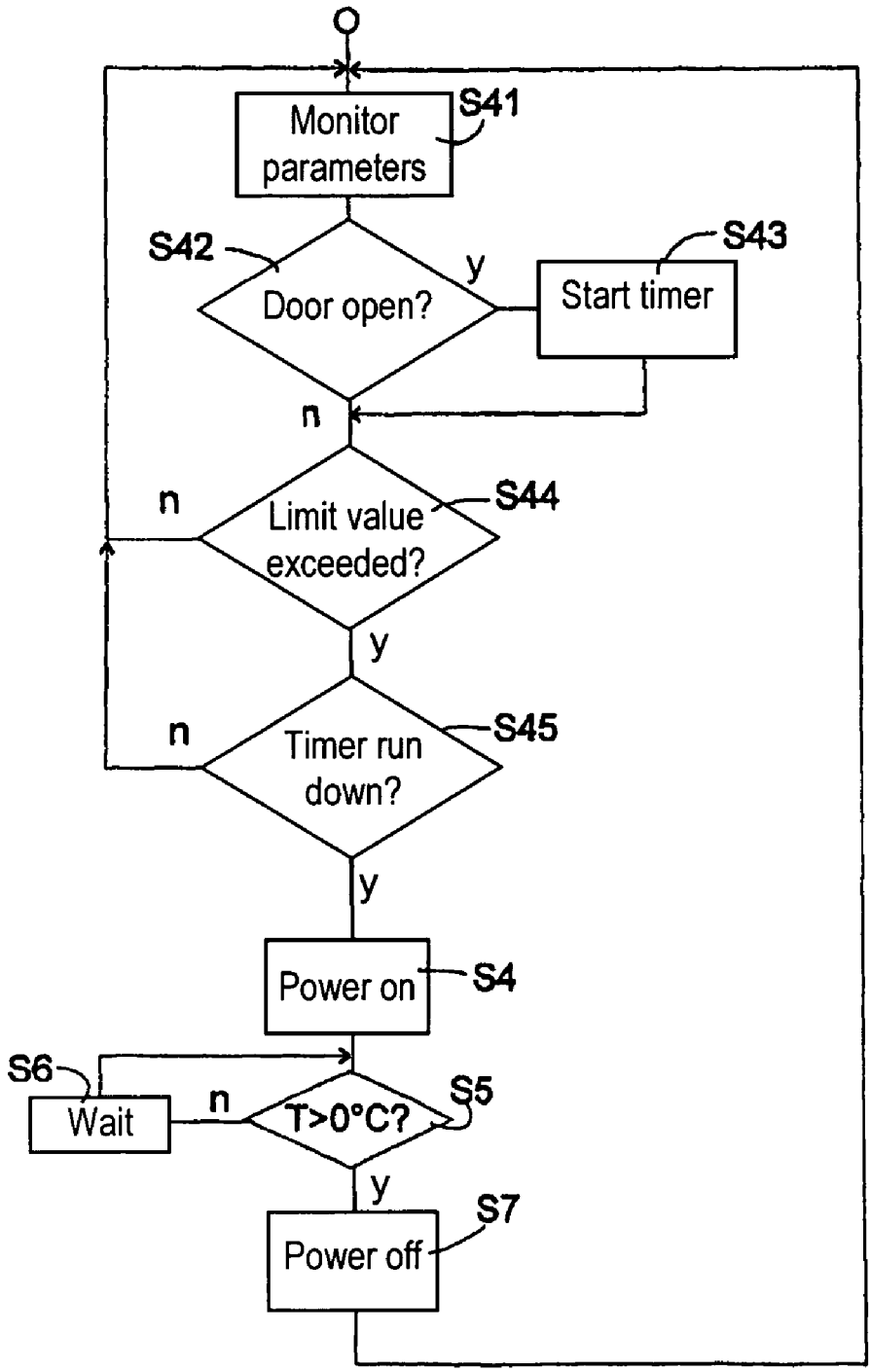
FIG. 8 is a flowchart for a method of operation of the control configuration of FIG. 7.

One alternative method that can be carried out with the control configuration from FIG. 7 is explained with reference to FIG. 8. In step S41, the value of any suitable parameter is detected, for example, the number of times the door has been opened or the length of time the door has been open, the compressor operating time, the total operating time, the ratio of compressor operating time to total operating time, etc. If it is found in step S42 that the door 2 has been opened, the timer 14 is started (S43), although the timer is not used to supply a time of day in this refinement, but to indicate that a predefined period of time of, for example, three hours has elapsed. These steps are cyclically repeated until it is found in step S44 that the monitored parameter has exceeded the limit value. If this is the case, a check must next (S45) be made as to whether or not the timer has timed out, that is to say, whether or not the predefined time since the last time the door was opened has elapsed. If this is not the case, steps S41 to S44 are run through in a loop until the timer has timed out.

The timing out of the timer indicates that defrosting may now be initiated because enough time has elapsed since the last time the door was opened and for any items to be frozen just put in to be reliably frozen. The subsequent steps are identical to steps S4 to S7 from FIG. 3 and, therefore, do not need to be explained again.

A secondary result of this control method is that the timer usually times out at night because the probability of the door remaining closed long enough for the timer to time out is greatest here. Therefore, predominantly low-cost, off-peak electricity can also be used for the defrosting process with the method from FIG. 8.

I claim:

1. A method of controlling a freezer having a cooling surface, and a heating device for heating and defrosting the cooling surface, a compressor for cooling the freezer, a door providing access to the freezer, a control circuit connected to the heating device, a timer, and a manual defrost button, the method comprising the acts of:

detecting a start time indicating when the compressor is turned on;

detecting an end time indicating when the compressor is turned off;

comparing the start time and end time and calculating an operating time indicating the duration of time the compressor is being operated;

initiating a defrost program if the operating time is greater than a pre-determined value;

initiating the defrost program if the operating time is less than the pre-determined value and the manual defrost button is actuated;

the defrost program comprising:

determining the time of day;

preventing operation of the heating device if the time of day is within a prohibited time interval;

operating the heating device to defrost the freezer if the time of day is within a permitted time interval; and stopping operation of the heating device and ending the defrost program when the temperature within the freezer is greater than 0 degrees Celsius.

* * * * *